US011769442B2

(12) United States Patent
Jo

(10) Patent No.: US 11,769,442 B2
(45) Date of Patent: Sep. 26, 2023

(54) LIGHT-EMITTING DISPLAY DEVICE PREVENTING OCCURRENCE OF COMPENSATION DEVIATION AND DRIVING METHOD THEREOF

(71) Applicant: LG Display Co., Ltd., Seoul (KR)

(72) Inventor: Seung Ju Jo, Goyang-si (KR)

( * ) Notice: Subject to any disclaimer, the term of this patent is extended or adjusted under 35 U.S.C. 154(b) by 0 days.

(21) Appl. No.: 17/894,938

(22) Filed: Aug. 24, 2022

(65) Prior Publication Data

US 2023/0186827 A1 Jun. 15, 2023

(30) Foreign Application Priority Data

Dec. 10, 2021 (KR) ..... 10-2021-0176664

(51) Int. Cl.
*G09G 3/20* (2006.01)
*G09G 3/00* (2006.01)

(52) U.S. Cl.
CPC ..... *G09G 3/2096* (2013.01); *G09G 3/006* (2013.01); *G09G 2310/0286* (2013.01); *G09G 2310/0289* (2013.01); *G09G 2320/043* (2013.01); *G09G 2330/021* (2013.01); *G09G 2360/16* (2013.01)

(58) Field of Classification Search
CPC ..... G09G 3/2096; G09G 3/006
USPC ..... 345/60, 87, 690
See application file for complete search history.

(56) References Cited

U.S. PATENT DOCUMENTS

| | | | | |
|---|---|---|---|---|
| 10,720,100 | B2 * | 7/2020 | Lee | G09G 3/3275 |
| 2003/0201727 | A1 * | 10/2003 | Yamazaki | G09G 3/3291 315/169.1 |
| 2009/0015604 | A1 * | 1/2009 | Ozaki | G09G 3/3225 345/694 |
| 2017/0069261 | A1 * | 3/2017 | Lee | G09G 3/3208 |
| 2022/0044619 | A1 * | 2/2022 | Sohn | G09G 3/2092 |
| 2022/0093059 | A1 * | 3/2022 | Yang | G09G 3/20 |
| 2022/0343826 | A1 * | 10/2022 | Lee | G09G 1/165 |

FOREIGN PATENT DOCUMENTS

| | | | |
|---|---|---|---|
| KR | 10-2020-0134584 | A | 12/2020 |
| KR | 10-2021-0101437 | A | 8/2021 |

* cited by examiner

*Primary Examiner* — Calvin C Ma
(74) *Attorney, Agent, or Firm* — SEED IP LAW GROUP LLP

(57) ABSTRACT

Provided is a light-emitting display apparatus including a display panel configured to display an image, a driving circuit configured to drive the display panel, a timing controller configured to control the driving circuit, and a compensation circuit configured to correct an accumulation period difference of accumulated data to compensate deterioration of an element included in the display panel based on fluctuation of a driving frequency for driving the display panel.

10 Claims, 11 Drawing Sheets

| | $f_1$ | $f_2$ | $f_3$ | $f_4$ | $f_5$ | $f_6$ | $f_7$ | $f_8$ | $f_9$ | $f_{10}$ |
|---|---|---|---|---|---|---|---|---|---|---|
| DRIVING FREQUENCY [Hz] | 30 | 45 | 60 | 75 | 53 | 57 | 73 | 67 | 48 | 62 |
| DRIVING FREQUENCY [msec] | 33.3 | 22.2 | 16.7 | 13.3 | 18.9 | 17.5 | 13.7 | 14.9 | 20.8 | 16.1 |
| CORRECTION TIME [msec] | 0.0 | 11.1 | 16.7 | 20.0 | 14.5 | 15.8 | 19.6 | 18.4 | 12.5 | 17.2 |

➔Frame Time (187.6msec) + CORRECTION TIME (145.8msec)
= 333.3msec

| | $f_1$ | $f_2$ | $f_3$ | $f_4$ | $f_5$ | $f_6$ | $f_7$ | $f_8$ | $f_9$ | $f_{10}$ |
|---|---|---|---|---|---|---|---|---|---|---|
| DRIVING FREQUENCY [Hz] | 60 | 35 | 35 | 50 | 71 | 36 | 37 | 57 | 43 | 56 |
| DRIVING FREQUENCY [msec] | 16.7 | 28.6 | 28.6 | 20.0 | 14.1 | 27.8 | 27.0 | 17.5 | 23.3 | 17.9 |
| CORRECTION TIME [msec] | 16.7 | 4.8 | 4.8 | 13.3 | 19.2 | 5.6 | 6.3 | 15.8 | 10.1 | 15.5 |

➔Frame Time (221.4msec) + CORRECTION TIME (112.0msec) = 333.3msec

LIGHT-EMITTING DISPLAY DEVICE PREVENTING OCCURRENCE OF COMPENSATION DEVIATION AND DRIVING METHOD THEREOF

CROSS-REFERENCE TO RELATED APPLICATIONS

This application claims priority to Korean Patent Application No. 10-2021-0176664, filed on Dec. 10, 2021, which is hereby incorporated by reference as if fully set forth herein.

BACKGROUND

Technical Field

Embodiments of the present disclosure relates to a light-emitting display apparatus and a driving method thereof.

Description of the Related Art

With the development of information technology, the market for display devices, which are connection media between users and information, has been growing. Accordingly, there has been an increase in use of display devices such as a light-emitting display device (LED), a quantum dot display device (QDD), and a liquid crystal display device (LCD).

The display devices described above each include a display panel including subpixels, a driving unit configured to output a driving signal for driving the display panel, a power supply unit configured to generate power to be supplied to the display panel or the driving unit, etc.

In each of the display devices, when a driving signal, for example, a scan signal, a data signal, etc., is supplied to the subpixels formed in the display panel, an image may be displayed by a selected subpixel transmitting light or directly emitting light.

BRIEF SUMMARY

The present disclosure is directed to a light-emitting display apparatus and a driving method thereof that substantially obviates one or more problems due to limitations and disadvantages of the related art.

One or more embodiments of the present disclosure reflect an accumulation period time according to driving frequency fluctuation to prevent distortion of accumulated data, and to prevent occurrence of compensation deviation due to failure to properly reflect a use time of a product.

Additional advantages and features of the present disclosure will be set forth in part in the description which follows and in part will become apparent to those having ordinary skill in the art upon examination of the following or may be learned from practice of the present disclosure. Other advantages of the present disclosure may be realized and attained by the structure particularly pointed out in the written description and claims hereof as well as the appended drawings.

To achieve these technical benefits and other advantages, as embodied and broadly described herein, a light-emitting display apparatus includes a display panel configured to display an image, a driving circuit configured to drive the display panel, a timing controller configured to control the driving circuit, and a compensation circuit configured to correct an accumulation period difference of accumulated data to compensate deterioration of an element included in the display panel based on fluctuation of a driving frequency for driving the display panel.

The compensation circuit may inspect a driving frequency using a method of counting a vertical synchronization signal, and calculate a correction time for correcting an accumulation period difference of accumulated data based on fluctuation of the driving frequency.

The compensation circuit may set, as a reference frequency, a lowest frequency among variable driving frequencies when the display panel is driven, and calculate the correction time including a weight added or subtracted as a driving frequency decreases or increases compared to the reference frequency.

The compensation circuit may compensate a time difference between a frame time of first accumulated data and a frame time of second accumulated data, accumulated based on one or more different driving frequencies during the same period.

The first accumulated data and the second accumulated data may have the same accumulation period as the correction time is applied.

The timing controller may receive corrected accumulated data from the compensation circuit, apply the corrected accumulated data to a lifespan curve to predict an amount of deterioration, extract compensation gain based on the predicted amount of deterioration, and generate a compensation data signal for compensating for deterioration of an element included in the display panel based on extracted compensation gain.

In another aspect of the present disclosure, a driving method of a light-emitting display apparatus includes inspecting a driving frequency based on a synchronization signal, setting, as a reference frequency, a lowest frequency among variable driving frequencies when a display panel is driven, and calculating a correction time for correcting an accumulation period difference due to a difference of a frequency lower or higher than the reference frequency, correcting an accumulation period difference of accumulated data based on the correction time to compensate deterioration of an element included in the display panel based on fluctuation of a driving frequency for driving the display panel, and compensating for a data signal to be supplied to the display panel based on corrected accumulated data.

The correction time may be added or subtracted as a driving frequency decreases or increases compared to the reference frequency.

A time difference between a frame time of first accumulated data and a frame time of second accumulated data, accumulated based on one or more different driving frequencies during the same period, may be compensated by the correction time.

The first accumulated data and the second accumulated data may have the same accumulation period as the correction time is applied.

It is to be understood that both the foregoing general description and the following detailed description of the present disclosure are intended to provide further examples and explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Reference will now be made in detail to the embodiments of the present disclosure, examples of which are illustrated in the accompanying drawings. Wherever possible, the same reference numbers will be used throughout the drawings to refer to the same or like parts.

The term "unit" may include any electrical circuitry, features, components, an assembly of electronic components or the like. That is, "unit" may include any processor-based or microprocessor-based system including systems using microcontrollers, integrated circuit, chip, microchip, reduced instruction set computers (RISC), application specific integrated circuits (ASICs), field-programmable gate arrays (FPGAs), graphical processing units (GPUs), logic circuits, and any other circuit or processor capable of executing the various operations and functions described herein. The above examples are examples only, and are thus not intended to limit in any way the definition or meaning of the term "unit."

In some embodiments, the various units described herein may be included in or otherwise implemented by processing circuitry such as a microprocessor, microcontroller, or the like.

According to some embodiments, the term "unit" includes within its meaning component, element, module, member, or the like.

A display device according to the present disclosure may be implemented as a television, a video player, a personal computer (PC), a home theater, an automobile electric device, a smartphone, etc., but is not limited thereto. The display device according to the present disclosure may be implemented as an LED, a QDD, an LCD, etc. However, hereinafter, for convenience of description, a light-emitting display device that directly emits light based on an inorganic light-emitting diode or an organic light-emitting diode will be given as an example.

Figure 1:
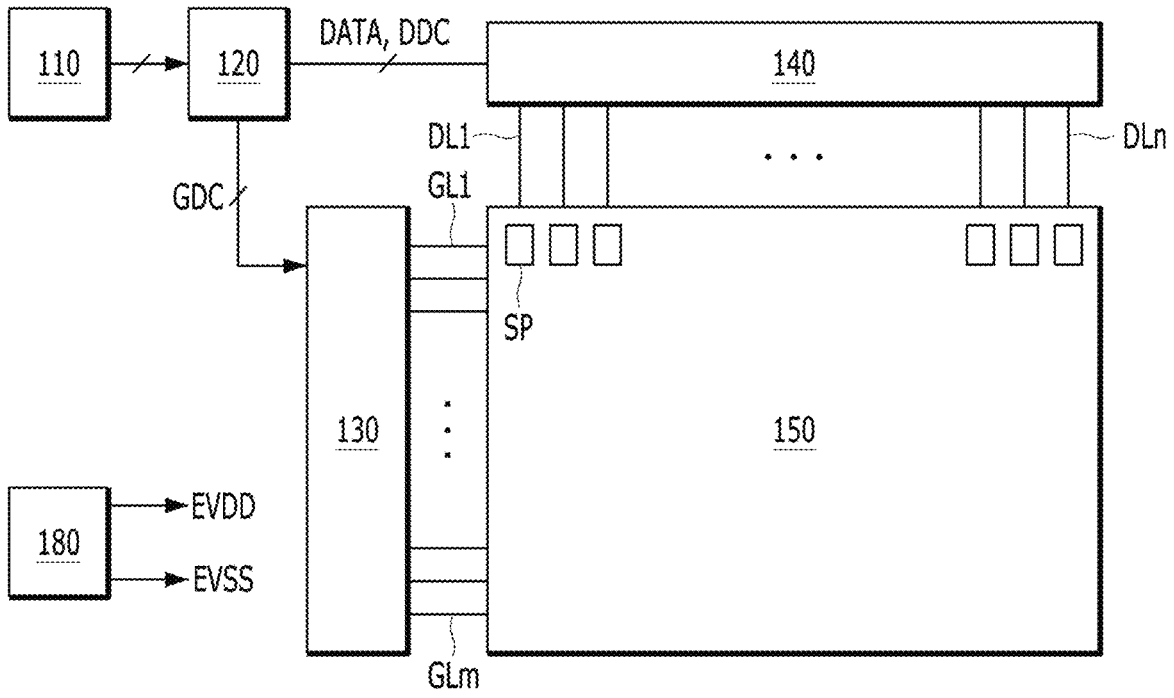
FIG. 1 is a block diagram schematically illustrating a light-emitting display device.
Figure 2:
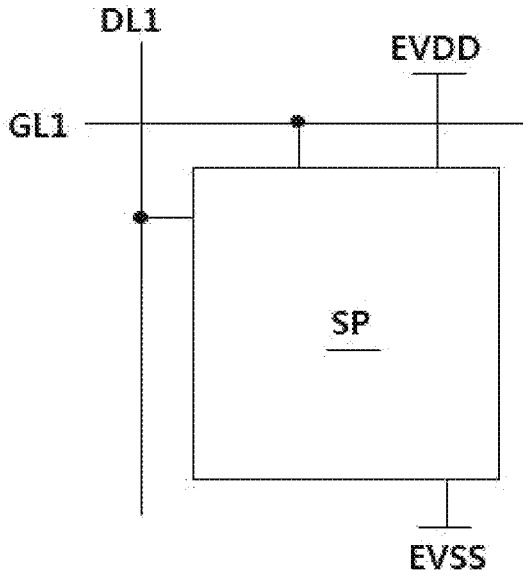
FIG. 2 is a configuration diagram schematically illustrating a subpixel illustrated in FIG. 1.

FIG. 1 is a configuration diagram schematically illustrating the light-emitting display device, and FIG. 2 is a block diagram schematically illustrating a subpixel illustrated in FIG. 1.

As illustrated in FIGS. 1 and 2, the light-emitting display device may include an image supply unit 110 (an image supply circuit 110), a timing controller 120, a gate driving unit 130 (a gate driving circuit 130), a data driving unit 140 (a data driving circuit 140), a display panel 150, a power supply unit 180 (a power supply circuit 180), etc.

The image supply unit (set or host system) 110 may output various driving signals along with an image data signal supplied from the outside or an image data signal stored in an internal memory. The image supply unit 110 may supply a data signal and various driving signals to the timing controller 120.

The timing controller 120 may output a gate timing control signal GDC for controlling the operation timing of the gate driving unit 130, a data timing control signal DDC for controlling the operation timing of the data driving unit 140, various synchronization signals (Vsync, which is a vertical synchronization signal, and Hsync, which is a horizontal synchronization signal), etc. The timing controller 120 may supply a data signal DATA supplied from the image supply unit 110 together with the data timing control signal DDC to the data driving unit 140. The timing controller 120 may be formed as an integrated circuit (IC) and mounted on a printed circuit board, but is not limited thereto.

The gate driving unit 130 may output a gate signal (or a scan signal) based on the gate timing control signal GDC supplied from the timing controller 120. The gate driving unit 130 may supply a gate signal to subpixels included in the display panel 150 through gate lines GL1 to GLm. The gate driving unit 130 may be formed as an IC or may be formed directly on the display panel 150 in a gate-in-panel method, but is not limited thereto.

The data driving unit 140 may sample and latch the data signal DATA based on the data timing control signal DDC supplied from the timing controller 120, convert a digital data signal into an analog data voltage based on a gamma reference voltage, and output the analog data voltage. The data driving unit 140 may supply a data voltage to the subpixels included in the display panel 150 through data lines DL1 to DLn. The data driving unit 140 may be formed as an IC and mounted on the display panel 150 or mounted on a printed circuit board, but is not limited thereto.

The power supply unit 180 may generate a first voltage having a high potential and a second voltage having a low potential based on an external input voltage supplied from the outside, and output the first voltage and the second voltage through a first power line EVDD and a second power line EVSS. The power supply unit 180 may generate and output a voltage necessary to drive the gate driving unit 130 (for example, a gate voltage including a gate high voltage and a gate low voltage) or a voltage necessary to drive the data driving unit 140 (a drain voltage including a drain voltage and a half-drain voltage) in addition to the first power and the second power.

The display panel 150 may display an image based on a driving signal including a gate signal and a data voltage, first power, second power, etc. The subpixels of the display panel 150 directly emit light. The display panel 150 may be manufactured based on a substrate having rigidity or flexibility, such as glass, silicon, polyimide, etc. In addition, the subpixels that emit light may include pixels including red, green, and blue or pixels including red, green, blue, and white.

For example, one subpixel SP may be connected to the first data line DL1, the first gate line GL1, the first power line EVDD, and the second power line EVSS, and may include a pixel circuit having a switching transistor, a driving transistor, a capacitor, an organic light-emitting diode (OLED), etc. Since the subpixel SP used in the light-emitting display device directly emits light, a circuit configuration is complicated. In addition, there are various compensation circuits for compensating for deterioration of the OLED that emits light as well as the driving transistor that supplies a driving current to the OLED. Accordingly, note that the subpixel SP is simply illustrated in the form of a block.

Meanwhile, in the above description, the timing controller 120, the gate driving unit 130, the data driving unit 140, etc., have been described as individual elements. However, depending on the implementation method of the light-emitting display device, one or more of the timing controller 120, the gate driving unit 130, and the data driving unit 140 may be integrated into one IC.

Figure 3:
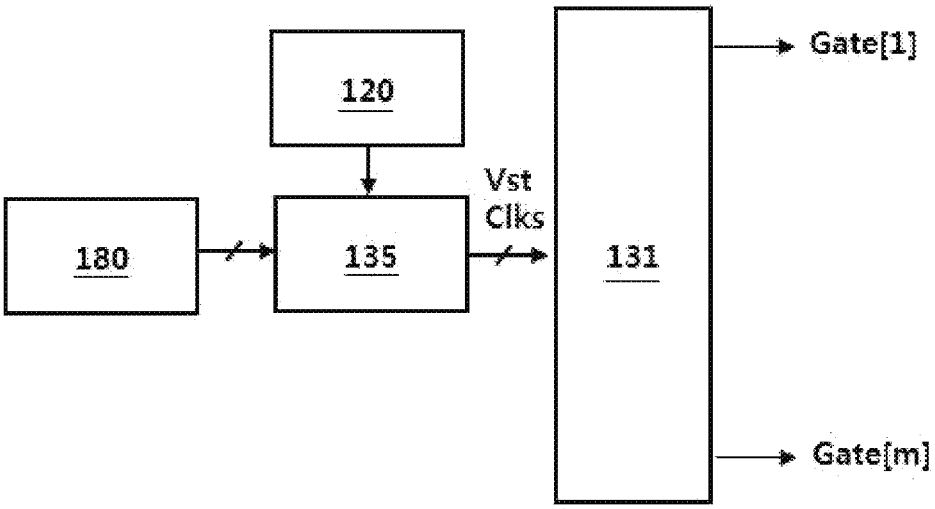
FIGS. 3 and 4 are diagrams for describing a configuration of a gate-in-panel type gate driving unit.
Figure 4:
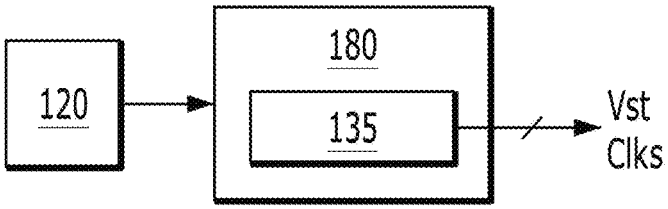
Figure 5A:
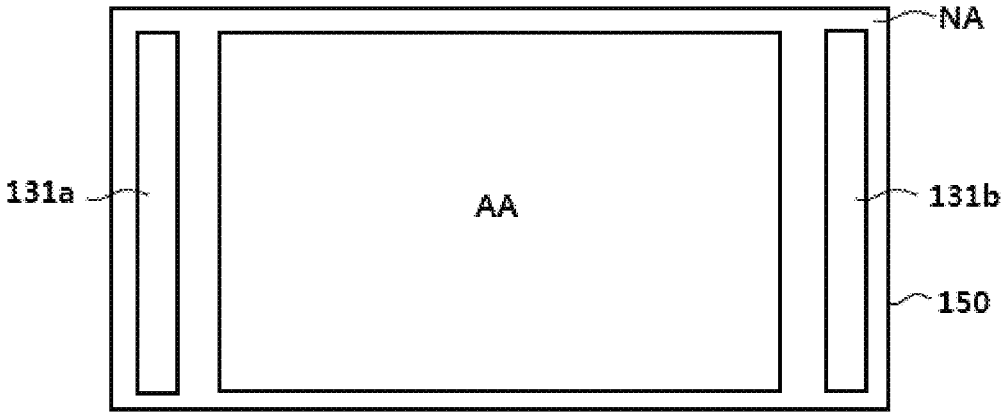
FIGS. 5A and 5B are diagrams illustrating arrangement examples of the gate-in-panel type gate driving unit.
Figure 5B:
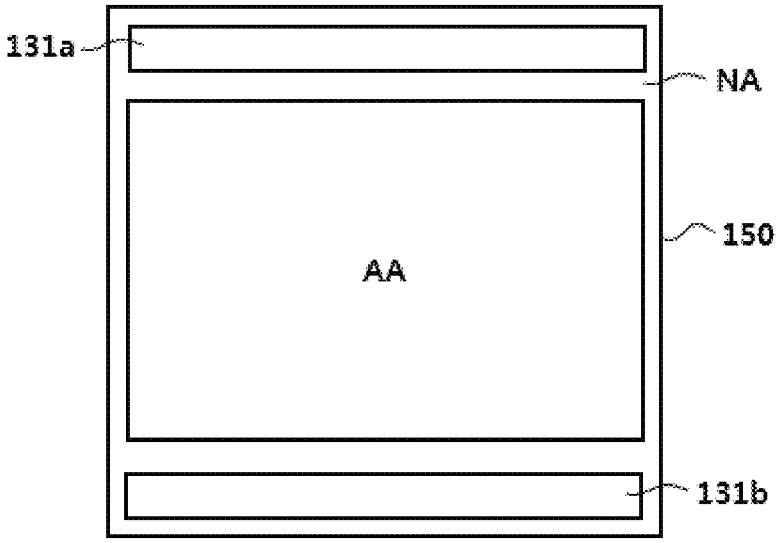

FIGS. 3 and 4 are diagrams for describing a configuration of a gate-in-panel type gate driving unit, and FIGS. 5A and 5B are diagrams illustrating arrangement examples of the gate-in-panel type gate driving unit.

As illustrated in FIG. 3, the gate-in-panel type gate driving unit 130 may include a shift register 131 and a level shifter 135. The level shifter 135 may generate clock signals Clks and a start signal Vst based on signals and voltages output from the timing controller 120 and the power supply unit 180. The clock signals Clks may be generated in the form of K (K being an integer greater than or equal to 2) different phases, such as two-phase, four-phase, and eight-phase.

The shift register 131 may operate based on the signals Clks and Vst output from the level shifter 135, and output gate signals Gate[1] to Gate[m] capable of turning on or off a transistor formed on the display panel. The shift register 131 may be formed as a thin film on the display panel using a gate-in-panel method.

As illustrated in FIGS. 3 and 4, unlike the shift register 131, the level shifter 135 may be independently formed as an IC or may be included in the power supply unit 180, which is only an example and the present disclosure is not limited thereto.

As illustrated in FIGS. 5A and 5B, in the gate-in-panel type gate driving unit, shift registers 131*a* and 131*b* for outputting gate signals may be disposed in a non-display area NA of the display panel 150. The shift registers 131*a* and 131*b* may be disposed in the non-display area NA in left and right parts of the display panel 150 as illustrated in FIG. 5A or may be disposed in the non-display area NA in upper and lower parts of the display panel 150 as illustrated in FIG. 5B. Meanwhile, in FIGS. 5A and 5B, the shift registers 131*a* and 131*b* are illustrated and described as being disposed in the non-display area NA as an example. However, the present disclosure is not limited thereto.

Figure 6:
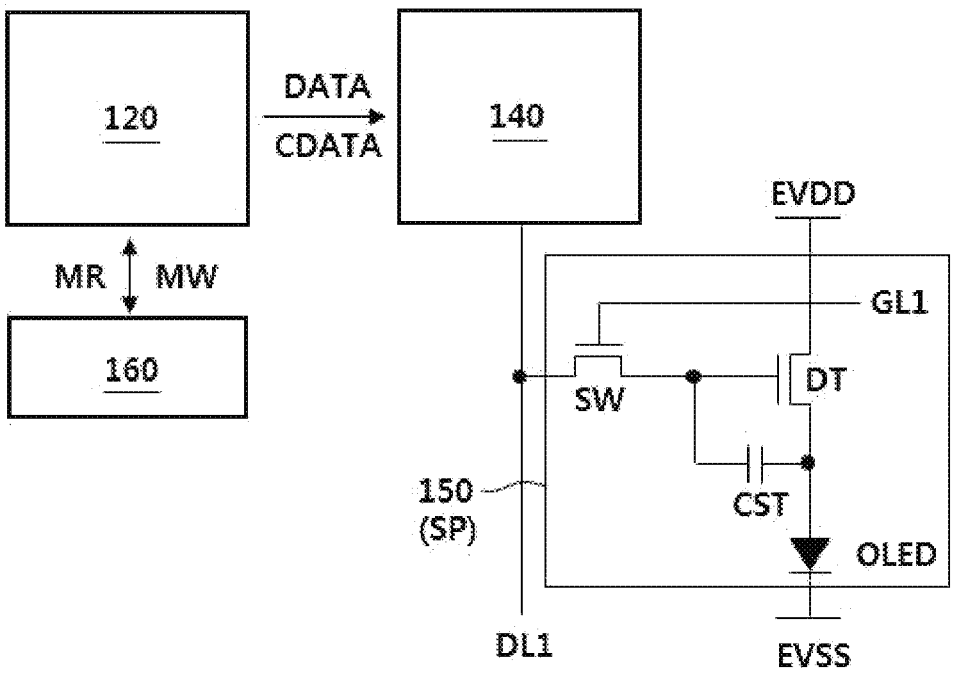
FIG. 6 is a schematic configuration diagram of a sensorless compensation type light-emitting display device.
Figure 7:
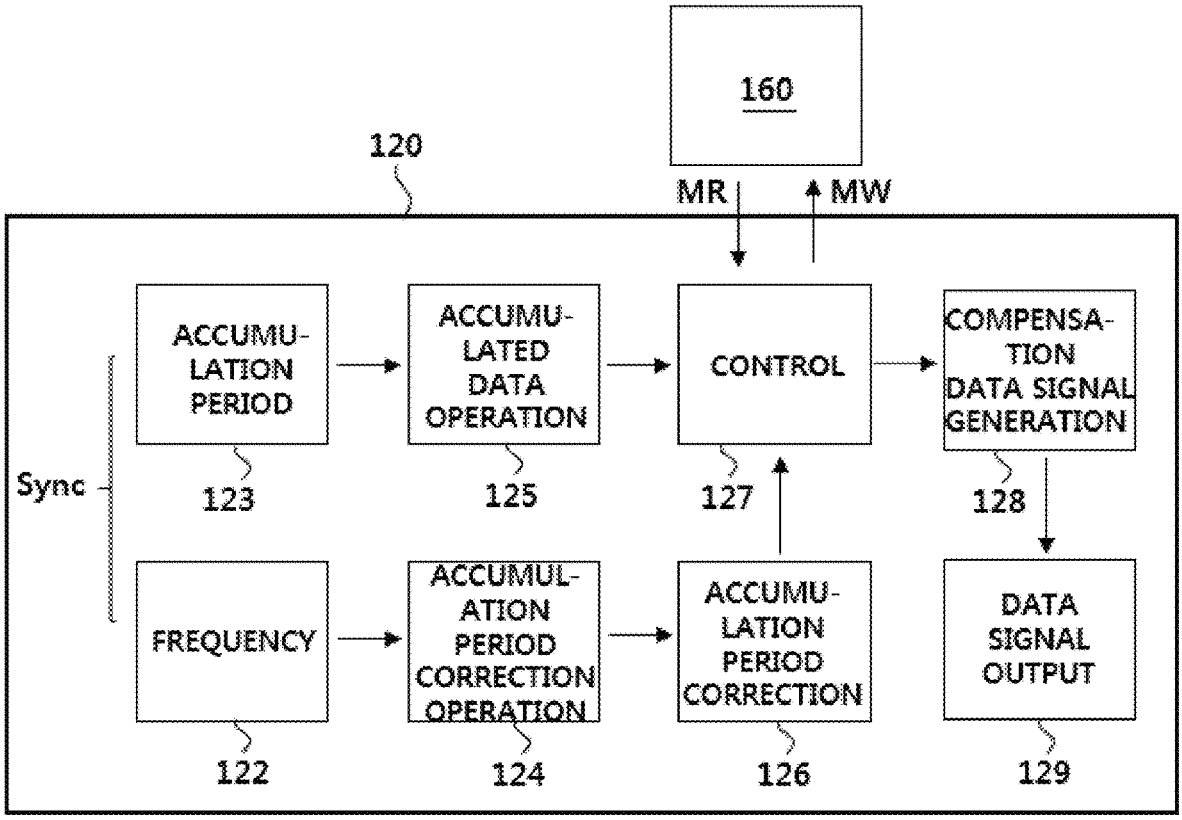
FIG. 7 is a configuration diagram of a timing controller for sensorless compensation according to an embodiment of the present disclosure.
Figure 8:
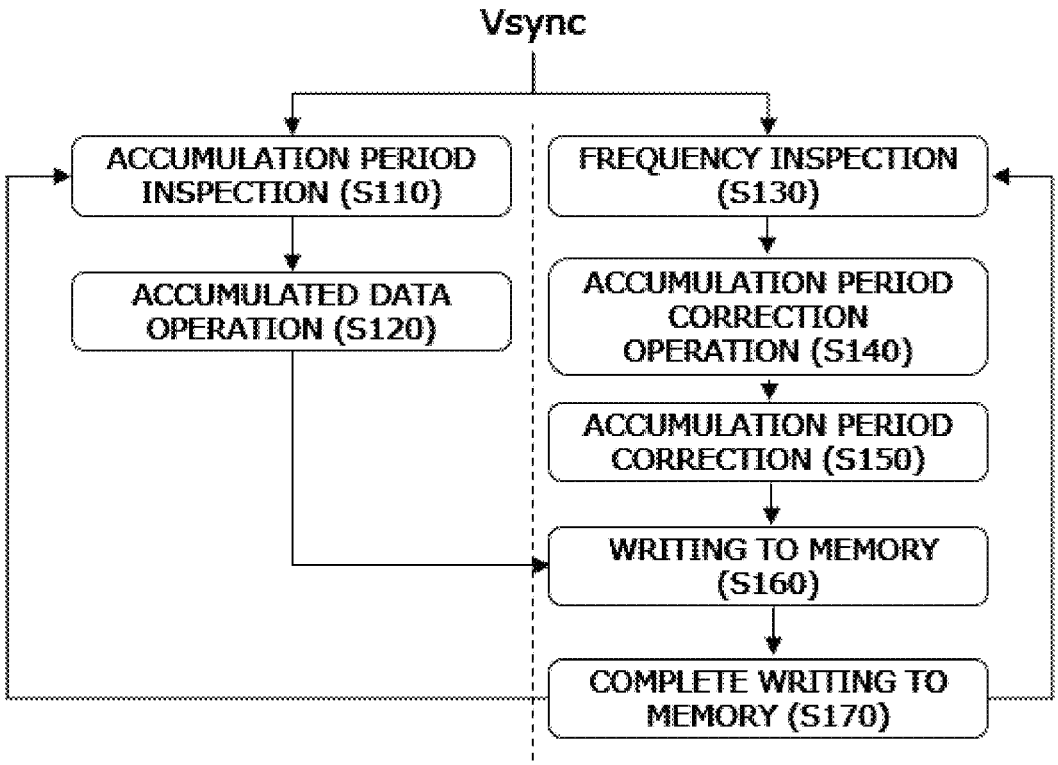
FIG. 8 is a flowchart illustrating a method of correcting an accumulation period by the timing controller and a memory illustrated in FIG. 7.
Figure 9:
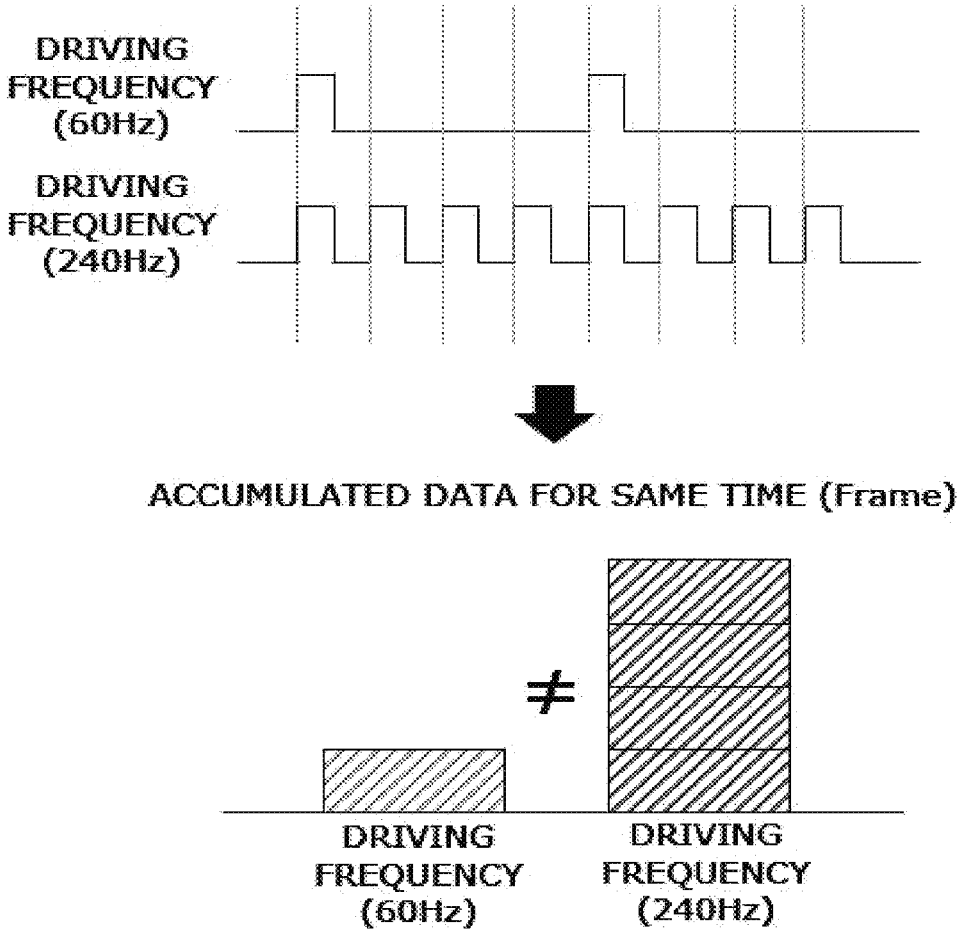
FIGS. 9 and 10 are diagrams for assisting in understanding of correction of an accumulation period of accumulated data according to an embodiment of the present disclosure.
Figure 10:
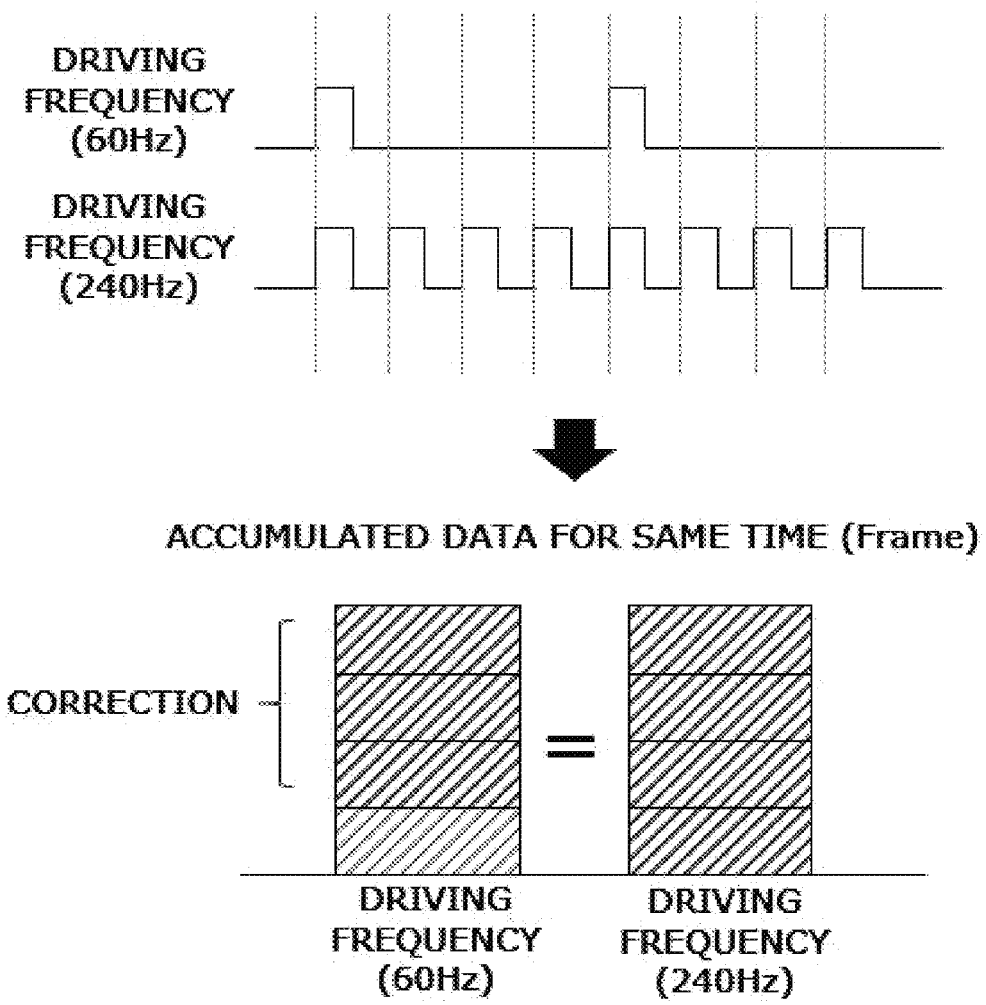

FIG. 6 is a schematic configuration diagram of a sensorless compensation type light-emitting display device, FIG. 7 is a configuration diagram of a timing controller for sensorless compensation according to an embodiment of the present disclosure, FIG. 8 is a flowchart illustrating a method of correcting an accumulation period by the timing controller and a memory illustrated in FIG. 7, and FIGS. 9 and 10 are diagrams for assisting in understanding of correction of an accumulation period of accumulated data according to an embodiment of the present disclosure.

As illustrated in FIG. 6, the sensorless compensation type light-emitting display device may be implemented by the display panel 150 based on a subpixel SP including a switching transistor SW, a driving transistor DT, a capacitor CST, and an organic light-emitting diode OLED.

The switching transistor SW may have a gate electrode connected to the first gate line GL1, a first electrode connected to the first data line DL1, and a second electrode connected to a gate electrode of the driving transistor DT and a first electrode of the capacitor CST. The switching transistor SW may serve to transfer a data voltage applied through the first data line DL1 to the first electrode of the capacitor CST.

The driving transistor DT may have the gate electrode connected to the second electrode of the switching transistor SW and the first electrode of the capacitor CST, a first electrode connected to the first power line EVDD, and a second electrode connected to a second electrode of the capacitor CST and an anode electrode of the organic light-emitting diode OLED. The driving transistor DT may serve to generate a driving current based on a data voltage stored in the capacitor CST.

The capacitor CST may have the first electrode connected to the second electrode of the switching transistor SW and the gate electrode of the driving transistor DT, and the second electrode connected to the second electrode of the driving transistor DT and an anode electrode of the organic light-emitting diode OLED. The capacitor CST may serve to store a data voltage for driving the driving transistor DT.

The organic light-emitting diode OLED may have the anode electrode connected to the second electrode of the driving transistor DT and the second electrode of the capacitor CST, and a cathode electrode connected to the second power line EVSS. The organic light-emitting diode OLED may serve to emit light based on an operation (driving current) of the driving transistor DT.

The subpixel SP described above does not include a circuit for compensating for deterioration of the driving transistor DT, etc. Instead, the subpixel SP described above may compensate deterioration of the driving transistor DT, etc., based on the timing controller 120 positioned outside the display panel 150.

The timing controller 120 may output the data signal DATA to display an image without change, or output a compensation data signal CDATA in which a compensation value corresponding to deterioration of the driving transistor DT is reflected. The timing controller 120 may include a compensation circuit (compensation algorithm) to compensate deterioration of the driving transistor DT, etc. Meanwhile, in the following description, an example in which the compensation circuit (compensation algorithm) is included in the timing controller 120 will be described. However, the compensation circuit (compensation algorithm) may be included in another device or separated as a separate device.

The timing controller 120 may analyze characteristics of an input data signal based on a data counting method of the compensation circuit provided therein, predict a degree of deterioration based on data stored in a memory 160, and compensate a data signal to be output. During the compensation operation, the timing controller 120 may read data stored in the memory 160 through a read operation MR, and may write newly updated data to the memory 160 through a write operation MW.

As illustrated in FIGS. 7 and 8, the timing control unit 120 according to the embodiment of the present disclosure may include an accumulation period inspection unit 123, an accumulated data operation unit 125, a frequency inspection unit 122, an accumulation period correction operation unit 124, an accumulation period correction unit 126, a controller 127, a compensation data signal generation unit 128, and a data signal output unit 129.

The accumulation period inspection unit 123 may inspect an accumulation period of an input data signal based on a synchronization signal Sync. For example, the accumulation period inspection unit 123 may inspect the accumulation period by counting a vertical synchronization signal Vsync. An accumulation period inspection (step S110 of FIG. 8) may be performed by the accumulation period inspection unit 123.

The accumulated data operation unit 125 may operate accumulated data to analyze characteristics of an input data signal based on a data counting method of counting an input data signal. The accumulated data may be used when predicting deterioration of an element included in a sub-pixel. The accumulated data operation unit 125 may accumulate input data signals in units of frames, pixels, blocks, etc., and then calculate an accumulated data operation value in order to analyze characteristics thereof. An accumulated data operation step (S120 of FIG. 8) may be performed by the accumulated data operation unit 125.

The frequency inspection unit 122 may inspect a driving frequency used for driving a device (data driving unit, gate driving unit, etc.) based on the synchronization signal Sync. For example, the frequency inspection unit 122 may inspect the driving frequency in the same manner as the accumulation period inspection unit 123 by counting the vertical synchronization signal Vsync. A frequency inspection step (S130 of FIG. 8) may be performed by the frequency inspection unit 122.

The accumulation period correction operation unit 124 may set, as a reference frequency, a lowest frequency among variable driving frequencies when the display panel is driven, and calculate a correction time for correcting an accumulation period difference due to a difference of a frequency lower or higher than the reference frequency. The correction time may be a correction factor for adjusting an accumulation period difference caused by a difference in driving frequency for each frame. Meanwhile, the correction time may be calculated to adjust the entire period by reflecting a delay time that may occur before writing the accumulated data to the memory 160. An accumulation period correction operation step (S140 of FIG. 8) may be performed by the accumulation period correction operation unit 124.

The accumulation period correction unit 126 may derive an accumulation period correction value for correcting the accumulation period difference for each frame based on the correction time calculated by the accumulation period correction operation unit 124. The accumulation period correction unit 126 may be linked with the accumulation period correction operation unit 124 to derive an accumulation period correction value for correcting the accumulation period difference for the accumulated data based on the correction time every N frames (N being a natural number equal to or greater than 2). An accumulation period correction step (S150 of FIG. 8) may be performed by the accumulation period correction unit 126.

The controller 127 may prepare corrected accumulated data capable of resolving an accumulation period difference caused by a difference in driving frequency for each frame based on an accumulated data calculation value transferred from the accumulated data operation unit 125 and an accumulation period correction value transferred from the accumulation period correction unit 126. In addition, the controller 127 may control the read operation MR and the write operation MW of the memory 160. The controller 127 may write the corrected accumulated data to the memory 160 through the write operation MW. A step (S160 of FIG. 8) of writing the corrected accumulated data to the memory 160 and a writing completion step (S170 of FIG. 8) may be performed by the controller 127.

The compensation data signal generation unit 128 may generate a compensation data signal based on the corrected accumulated data transmitted through the controller 127. A description related to the compensation data signal generation unit 128 will be given again below.

The data signal output unit 129 may output an uncompensated data signal (a data signal only image-processed according to the display panel as an input data signal) or a data signal including the compensation data signal generated by the compensation data signal generation unit 128. The data signal output unit 129 may output a data signal through an interface coupled to the data driving unit.

As illustrated in FIG. 9, even when the accumulated data is prepared for the same time, more accumulated data may be prepared when driving based on a second driving frequency (240 Hz) higher than a first driving frequency (60 Hz). This means that the absolute time of the accumulation period may change according to fluctuation in frequency, such as a late or fast driving frequency. As such, when the absolute time of the accumulation period changes according to fluctuation in the driving frequency, the accumulated data may be distorted.

As illustrated in FIG. 10, the embodiment of the present disclosure may solve a problem that the absolute time of the accumulation period may change according to fluctuation in the driving frequency even when data is accumulated for the same time. In the embodiment of the present disclosure, the accumulation period of the accumulated data may be corrected (so that the absolute time of the accumulation period remains the same in all frames) based on fluctuation (variation) of the driving frequency in order to prevent distortion of the accumulated data. To put it simply, the embodiment of the present disclosure may uniformize (equalize) the correction time by adding or subtracting the correction time in order to solve a problem that the accumulation period of the accumulated data becomes faster or slower according to change of the driving frequency. A part related thereto will become clear through the following description.

Figure 11:
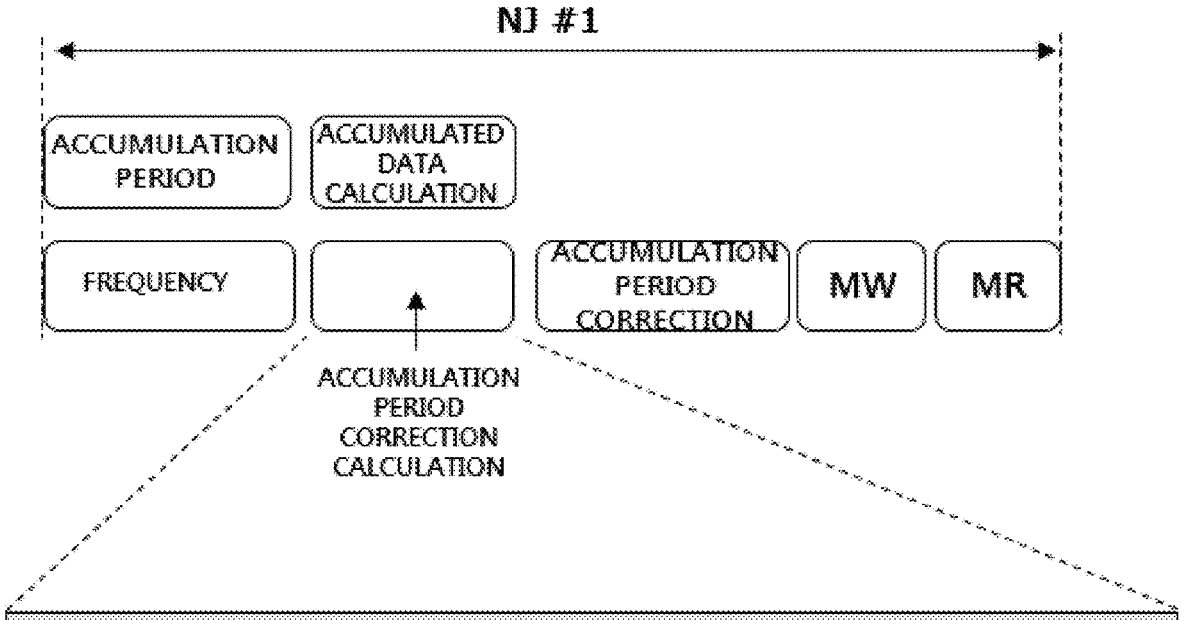
FIGS. 11 and 12 are illustrative diagrams for assisting in understanding of a method of correcting an accumulation period of accumulated data according to an embodiment of the present disclosure.
Figure 12:
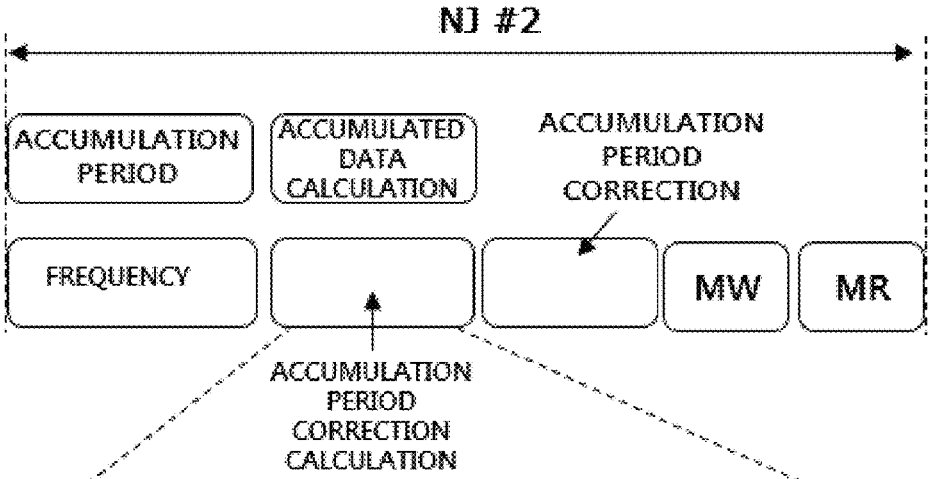

FIGS. 11 and 12 are diagrams for assisting in understanding of a method of correcting the accumulation period of the accumulated data according to an embodiment of the present disclosure.

First accumulated data NJ #1 and second accumulated data NJ #2 illustrated in FIGS. 11 and 12, respectively, are examples of acquiring accumulated data while changing the driving frequency during the same period. The first accumulated data NJ #1 and the second accumulated data NJ #2 may be accumulated data acquired during a period in which the driving frequency is changed a total of 10 times from a first driving frequency f1 to a tenth driving frequency f10. However, a frequency band of driving frequencies varied for acquisition of the first accumulated data NJ #1 and a frequency band of driving frequencies varied for acquisition of the second accumulated data NJ #2 are different from each other.

When the driving frequencies varied for acquisition the first accumulated data NJ #1 are changed in a unit of msec (millisecond) instead of a unit of Hz, are summed, and are displayed as a frame time, 187.6 msec is obtained. In addition, when the driving frequencies varied for acquisition of the second accumulated data NJ #2 are changed in a unit of msec instead of a unit of Hz, are summed, and are displayed as a frame time, 221.4 msec is obtained.

As can be seen by comparing the first accumulated data NJ #1 with the second accumulated data NJ #2, the second accumulated data NJ #2 is acquired under a faster driving condition than that of the first accumulated data NJ #1. As such, due to a difference in driving frequency, the absolute time of the accumulation period may be different between the first accumulated data NJ #1 and the second accumulated data NJ #2 even when data is accumulated for the same time.

To solve such a problem, the embodiment of the present disclosure may set a lowest frequency (30 Hz) among driving frequencies as a reference frequency, and calculate a correction time including a weight that can be added or subtracted by the frame time as a frequency decreases or increases compared to the reference frequency. In addition, a time difference between two pieces of accumulated data may be corrected by adding the correction time. As a result, the first accumulated data NJ #1 and the second accumulated data NJ #2 may have the same accumulation period (or the same data accumulation time) as the correction time is applied. Meanwhile, in the examples of FIGS. 11 and 12, the lowest frequency among the driving frequencies is set to 30 Hz. However, this is only an example, and the present disclosure is not limited thereto.

According to the correction method according to the embodiment, it can be seen that a correction time of 145.8 msec is added to the first accumulated data (NJ #1) and a correction time of 112.0 msec is added to the second accumulated data (NJ #2), and thus a difference therebetween is corrected.

As such, in the embodiment, since the total accumulation period can be adjusted by adding the correction time equal to an insufficient time after inspecting the driving frequency when the accumulated data is prepared, it is possible to prevent occurrence of compensation deviation due to failure to properly reflect the use time of the product.

Figure 13:
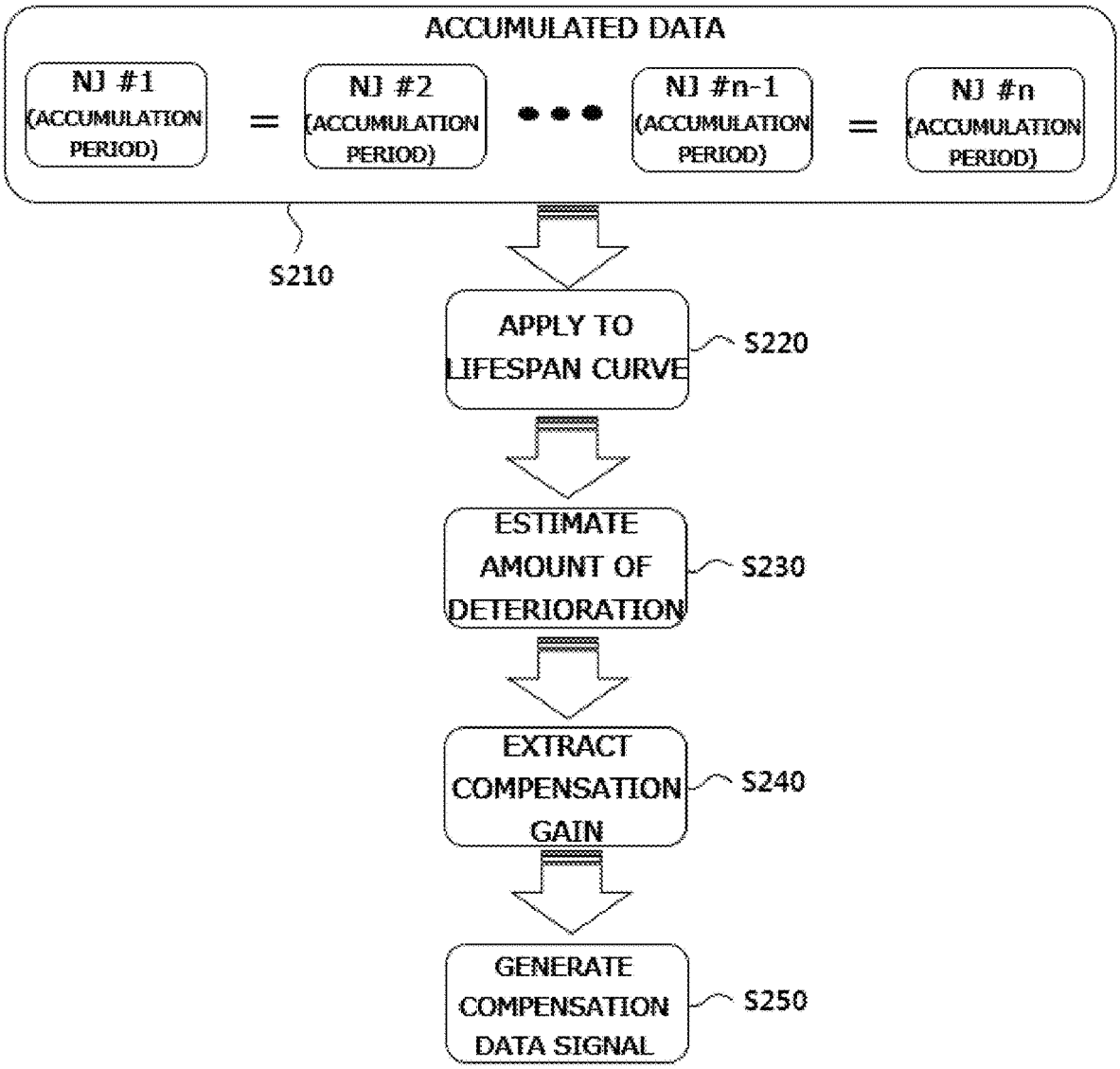
FIG. 13 is a diagram for describing a method of generating a compensation data signal based on an embodiment of the present disclosure.

FIG. 13 is a diagram for describing a method of generating a compensation data signal based on an embodiment of the present disclosure.

As illustrated in FIG. 13, in a method of generating a compensation data signal based on an embodiment of the present disclosure, accumulated data obtained by correcting a difference between pieces of accumulated data may be extracted (S210) and applied to a lifespan curve (a deterioration model or a deterioration map) (S220), and the amount of deterioration may be predicted based thereon (S230). Further, compensation gain for compensating therefor may be extracted based on the predicted amount of deterioration (S240), and a compensation data signal may be generated based on the extracted compensation gain (S250).

As such, when a compensation data signal is generated based on the embodiment of the present disclosure and then an image is displayed based thereon, it is possible to prevent occurrence of compensation deviation due to failure to properly reflect a use time of a product since the absolute time of an accumulation period is different due to a difference in driving frequency even when data is accumulated for the same time.

As described above, the present disclosure has the effect of preventing distortion of accumulated data by reflecting an accumulation period time according to fluctuation of a driving frequency. In addition, the present disclosure has the effect of preventing occurrence of compensation deviation due to failure to properly reflect a use time of a product since the absolute time of an accumulation period is different due to a difference in driving frequency even when data is accumulated for the same time.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A light-emitting display apparatus comprising:

a display panel configured to display an image;

a driving circuit configured to drive the display panel;

a timing controller configured to control the driving circuit; and a compensation circuit configured to correct an accumulation period difference of accumulated data to compensate deterioration of an element included in the display panel based on fluctuation of a driving frequency for driving the display panel, wherein the timing controller is configured to calculate a correction time for correcting an accumulation period difference due to a difference of a frequency lower or higher than a reference frequency, and wherein the timing controller is configured to correct the accumulation period difference of accumulated data that has accumulated based on the correction time in order to compensate for deterioration of an element included in the display panel.

2. A light-emitting display apparatus comprising: a display panel configured to display an image;

a driving circuit configured to drive the display panel;

a timing controller configured to control the driving circuit; and a compensation circuit configured to correct an accumulation period difference of accumulated data to compensate deterioration of an element included in the display panel based on fluctuation of a driving frequency for driving the display panel, wherein the compensation circuit inspects a driving frequency using a method of counting a vertical synchronization signal, and calculates a correction time for correcting an accumulation period difference of accumulated data based on fluctuation of the driving frequency.

3. The light-emitting display apparatus according to claim 2, wherein the compensation circuit sets, as a reference frequency, a lowest frequency among variable driving frequencies when the display panel is driven, and calculates the correction time including a weight being added to increase or being subtracted to decrease the driving frequency compared to the reference frequency.

4. The light-emitting display apparatus according to claim 2, wherein the compensation circuit compensates a time difference between a frame time of a first accumulated data and a frame time of a second accumulated data, accumulated based on one or more different driving frequencies during the same period.

5. The light-emitting display apparatus according to claim 4, wherein the first accumulated data and the second accumulated data have a same accumulation period when the correction time is applied.

6. The light-emitting display apparatus according to claim 1, wherein the timing controller receives a corrected accumulated data from the compensation circuit, applies the corrected accumulated data to a lifespan curve to predict an amount of deterioration, extracts a compensation gain based on the predicted amount of deterioration, and generates a compensation data signal for compensating deterioration of an element included in the display panel based on the extracted compensation gain.

7. A method of driving a light-emitting display apparatus, the method comprising:

inspecting a driving frequency based on a synchronization signal;

setting, as a reference frequency, a lowest frequency among variable driving frequencies when a display panel is driven;

calculating a correction time for correcting an accumulation period difference due to a difference of a frequency lower or higher than the reference frequency;

correcting the accumulation period difference of accumulated data, accumulated based on the correction time, to compensate deterioration of an element included in the display panel based on fluctuation of the driving frequency for driving the display panel; and compensating for a data signal to be supplied to the display panel based on the corrected accumulated data.

8. The method according to claim 7, wherein the correction time is added to increase or subtracted to decrease the driving frequency compared to the reference frequency.

9. The method according to claim 7, wherein a time difference between a frame time of a first accumulated data and a frame time of a second accumulated data, accumulated based on one or more different driving frequencies during the same period, is compensated by the correction time.

10. The method according to claim 9, wherein the first accumulated data and the second accumulated data have the same accumulation period when the correction time is applied.

* * * * *